US005772487A

United States Patent [19]

Lee

[11] Patent Number: 5,772,487

[45] Date of Patent: Jun. 30, 1998

[54] METHOD FOR MANUFACTURING METAL HALIDE LAMP

[75] Inventor: Seong-ho Lee, Taejeon, Rep. of Korea

[73] Assignee: Samsung Display Devices Co., Ltd., Kyungki-do, Rep. of Korea

[21] Appl. No.: 673,203

[22] Filed: Jun. 27, 1996

[30] Foreign Application Priority Data

Dec. 18, 1995 [KR] Rep. of Korea ..... 51370

[51] Int. Cl.[6] ..... H01J 9/32

[52] U.S. Cl. ..... 445/26; 445/43

[58] Field of Search ..... 445/26, 43

[56] References Cited

U.S. PATENT DOCUMENTS 5,213,536 5/1993 Hough et al. ..... 445/43 X 5,310,374 5/1994 Tomoyuki ..... 445/43

*Primary Examiner*—Kenneth J. Ramsey

*Attorney, Agent, or Firm*—Leydig, Voit & Mayer, Ltd.

[57] ABSTRACT

A method for manufacturing a metal halide lamp is disclosed. According to the method, an internal lead wire of an arc tube can be electrically connected to an external lead wire for applying current thereto by sealing a surrounding case thereby omitting a process of welding a metal lamina affixed to the external lead wire to the internal lead wire of the arc tube. Thus, productivity can be enhanced and it is easy to handle and preserve components for manufacturing the metal halide lamp.

1 Claim, 3 Drawing Sheets

METHOD FOR MANUFACTURING METAL HALIDE LAMP

BACKGROUND OF THE INVENTION

The present invention relates to a method for manufacturing a metal halide lamp.

The metal halide lamp has various forms and uses and is widely employed in places requiring high luminance. FIG. 1 is a schematic view of a general metal halide lamp.

Referring to FIG. 1, a metal halide lamp 100 includes a transparent cylindrical case 10 with first and second ends 11 and 12 sealed and an arc tube 20 fixed in the interior of the case 10. The arc tube 20 includes a pair of electrodes 21 and first and second internal lead wires 23 and 24 connected to each electrode 21 via a metal plate 22.

The first end 11 of the case 10 is sealed around a first external lead wire 40, and the second end 12 thereof is sealed around a second external lead wire 41. One end of the first external lead wire 40 is connected to the first internal lead wire 23 via a first metal lamina 30, and the other end protrudes toward the outside of the case 10.

The second lead wire 41 is connected to the second internal lead wire 24 via a second metal lamina 31 in the same way.

In the above-mentioned metal halide lamp 100, when a power supply is connected to the external lead wires 40 and 41, potential difference between the electrodes 21 is formed. Thus, arc discharge occurs inside the arc tube 20 to thereby generate light. Here, the case 10 prevents the heat generated during the arc discharge from being dissipated. The metal laminas 30 and 31 absorb thermal expansion of the internal lead wires 23 and 24 and the external lead wires 40 and 41, and act as a disperser when excessive electrical current is applied.

Meanwhile, to manufacture the metal halide lamp 100 of FIG. 1, by a conventional method, the arc tube 20 having the first and second internal lead wires 23 and 24, the first external lead wire 40 with the first metal lamina 30 affixed to one end, and the second external lead wire 41 with the second metal lamina 31 affixed to one end are first provided. Then, the first metal lamina 30 is electrically connected to the first internal lead wire 23 by welding and the second metal lamina 31 is electrically connected to the second internal lead wire 24 by welding.

After that, as shown in FIG. 2, a body of the arc tube 20, where the external lead wires 40 and 41 are connected, is supported by an arc tube support 61 which is attached to a fixing member 60, and then the fixing member 60 is set in the first end 11 of the case 10. Then, the second external lead wire 41 positioned in the second end 12 of the case 10 is inserted into a lead support 50.

Here, while the second end 12 of the case 10 is heated, and a pair of sealing members 80 are brought together as shown in FIG. 3 to thereby seal the second end 12 of the case 10. Accordingly, the second internal lead wire 24 and the second external lead wire 41 connected to the second internal lead wire 24 via the second metal lamina 31 are fixed to the second end 12 of the case 10.

Next, the fixing member 60 is separated from the first end 11 of the case, which is then sealed by the same method used for sealing the second end 12. Thus, the first internal lead wire 23 and the first external lead wire 40 are connected via the first metal lamina 30 and fixed to the first end 11 of the case 10.

However, the conventional method for manufacturing a metal halide lamp, as shown, requires a process of welding the first metal lamina 30 to the first internal lead wire 23 and the second metal lamina 31 to the second internal lead wire 24. Also, the connection of external lead wires 40 and 41 to the arc tube 20 increases the total length of the arc tube 20. Accordingly, it is difficult to handle and store the arc tube 20. Furthermore, the metal laminas 30 and 31 or the external lead wires 40 and 41 may be damaged or easily separated from the internal lead wires 23 and 24.

SUMMARY OF THE INVENTION

Accordingly, it is an object of the present invention to provide a method for manufacturing a metal halide lamp wherein a process of welding a metal lamina fixed to an external lead wire to an internal lead wire of an arc tube is omitted to enhance productivity and facilitate handling and preservation of each component necessary for manufacturing the metal halide lamp.

To accomplish the above object, there is provided a method for manufacturing a metal halide lamp comprising the steps of: positioning and fixing an arc tube having an electrode and an internal lead wire connected to the electrode inside a cylindrical case; positioning and fixing an external lead wire with a metal lamina affixed to one end thereof in the case so that the metal lamina contacts an outer surface of the internal lead wire at the end thereof; and fixing the internal lead wire and external lead wire by sealing an end of the case, thereby connecting the metal lamina and internal lead wire to each other.

BRIEF DESCRIPTION OF THE DRAWINGS

The above object and advantages of the present invention will become more apparent by describing in detail a preferred embodiment thereof with reference to the attached drawings in which.

DETAILED DESCRIPTION OF THE INVENTION

Figure 1:
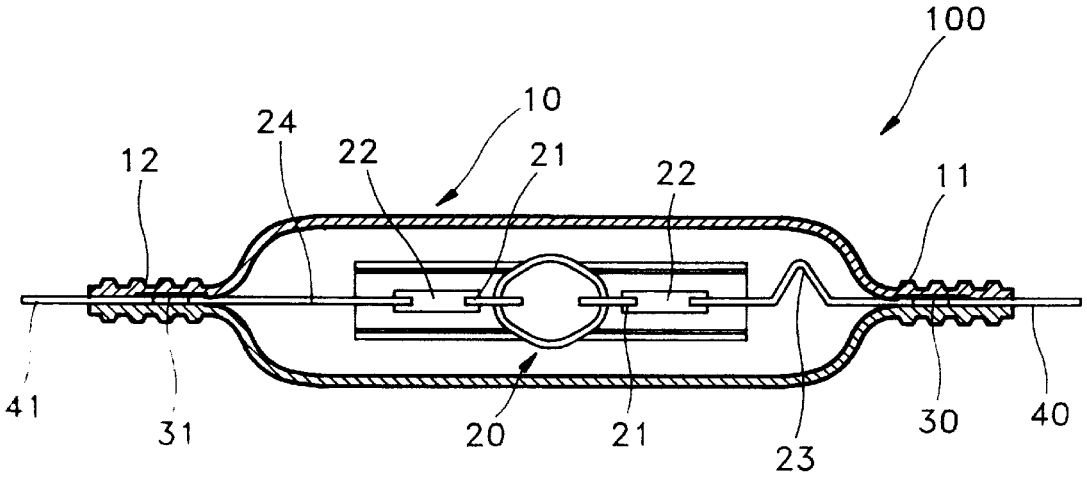
FIG. 1 is a sectional view schematically showing a general metal halide lamp.
Figure 2:
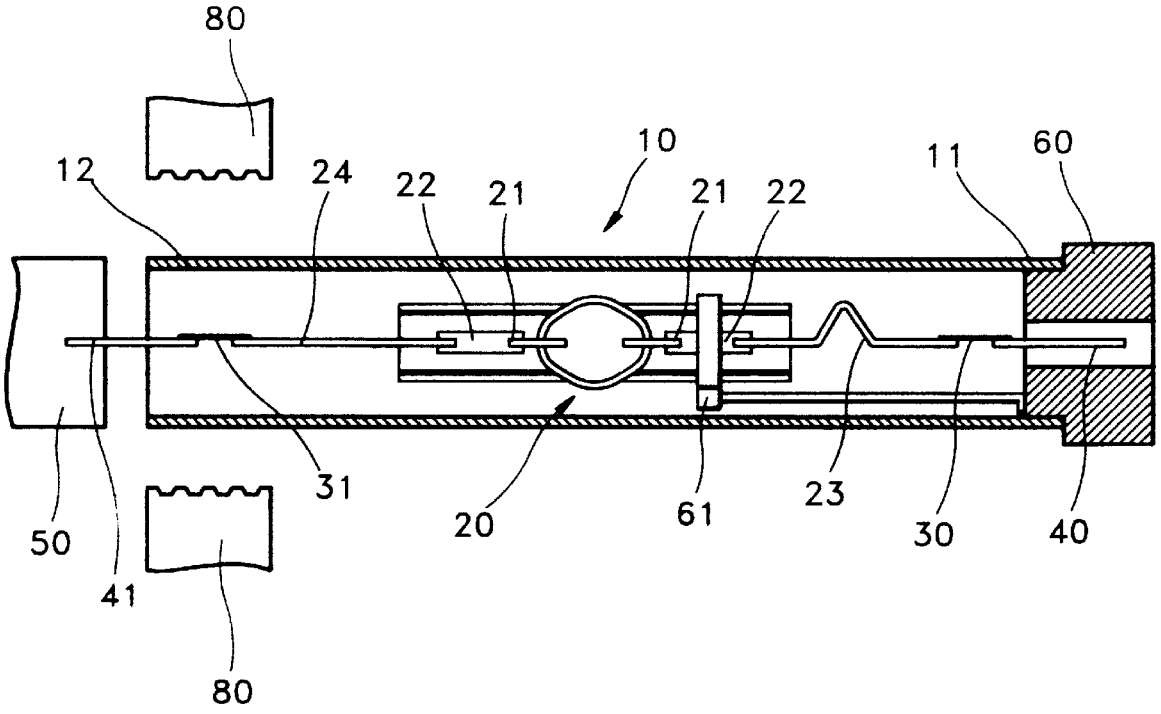
FIG. 2 (PRIOR ART)
FIGS. 2 and 3 are views illustrating a conventional method for manufacturing a metal halide lamp.
Figure 3:
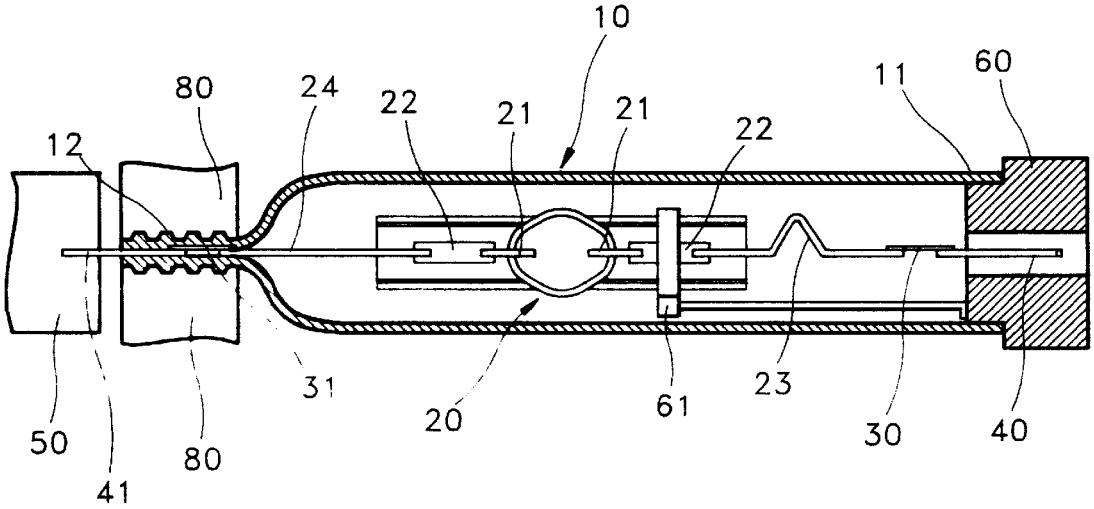
FIG. 3 (PRIOR ART)

Referring to FIGS. 1 and 4–6, there are first provided the arc tube 20 having the electrodes 21 and the first and second internal lead wires 23 and 24 connected to the electrodes 21 through metal laminas 22, the first external lead wire 40 with the first metal lamina 30 welded to one end and the second external lead wire 41 with the second metal lamina 31 welded to one end.

Figure 4:
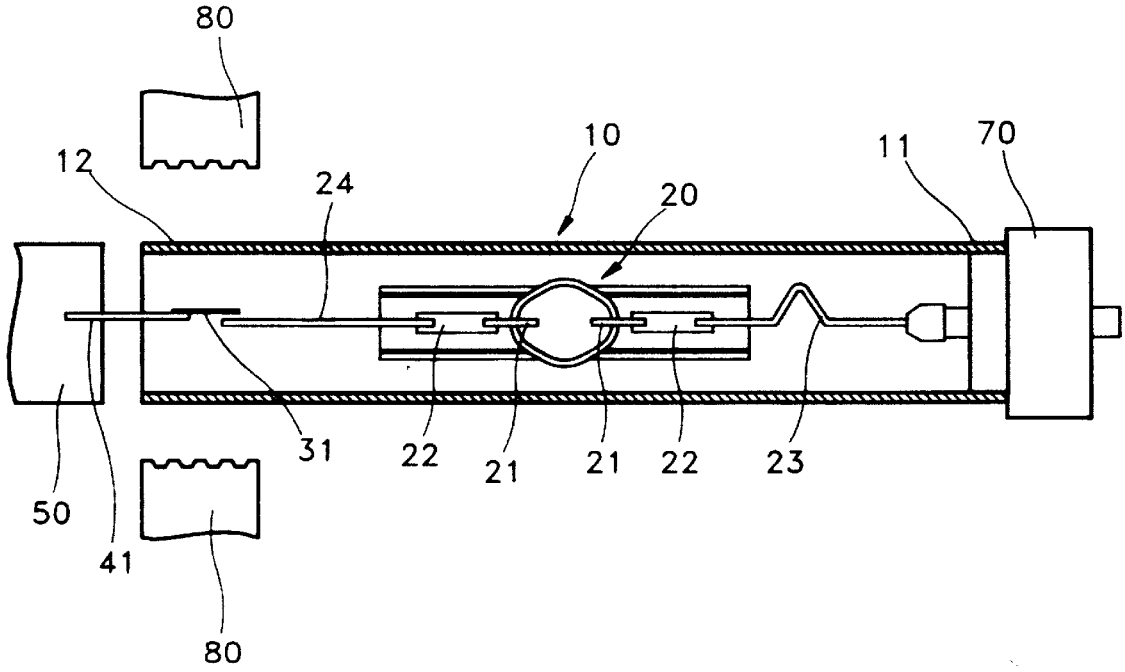
FIGS. 4 through 6 are views illustrating a method for manufacturing a metal halide lamp according to the present invention.

Next, as shown in FIG. 4, the first internal lead wire 23 is inserted into a fixing member 70, to thereby support the arc tube 20. Then, the fixing member 70 is set into the first end 11 of the cylindrical case 10 to fix the arc tube 20 inside the case 10. The second external lead wire 41 where the second metal lamina 31 is affixed is inserted into the second end 12 of the case 10, and fixed such that the second metal lamina 31 is positioned on an outer surface of the second internal lead wire 24 at the end thereof. Here, the second external lead wire 41 is supported by the lead support 50.

Further, in FIG. 4, a space between the second metal lamina 31 and the second internal lead wire 24 indicates no welding occurs. However, the second metal lamina 31 and the outer surface of the second internal lead wire 24 are in contact with each other.

Figure 5:
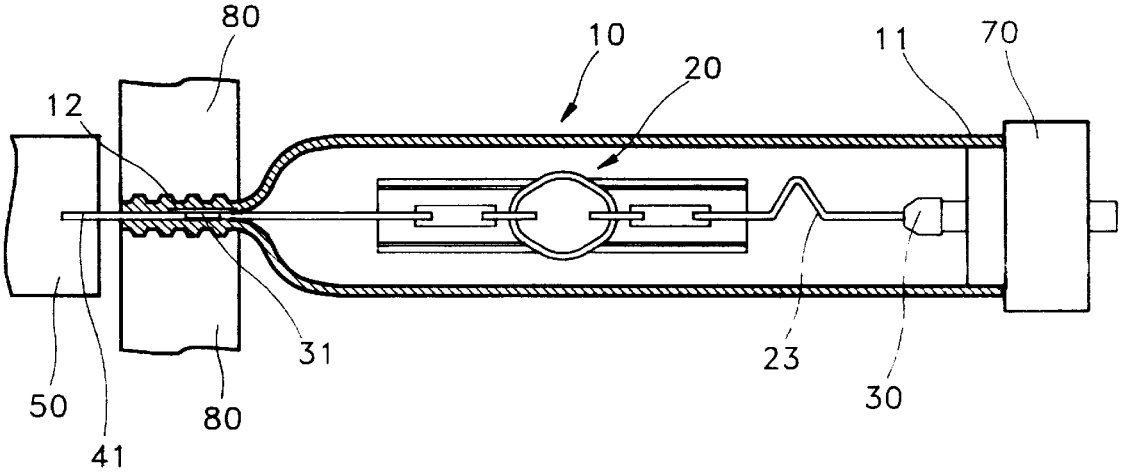

To seal the second end 12 of the case 10, heat is applied and the pair of sealing members 80 compress the case 10 together as shown in FIG. 5. Accordingly, the second internal lead wire 24 and the second external lead wire 41 are fixed to the second end 12 of the case 10. Here, the second metal lamina 31 and the second internal lead wire 24 contact with each other. Thus, the second external lead wire 41 and the second internal lead wire 24 are electrically connected to each other through the second metal lamina 31.

Figure 6:
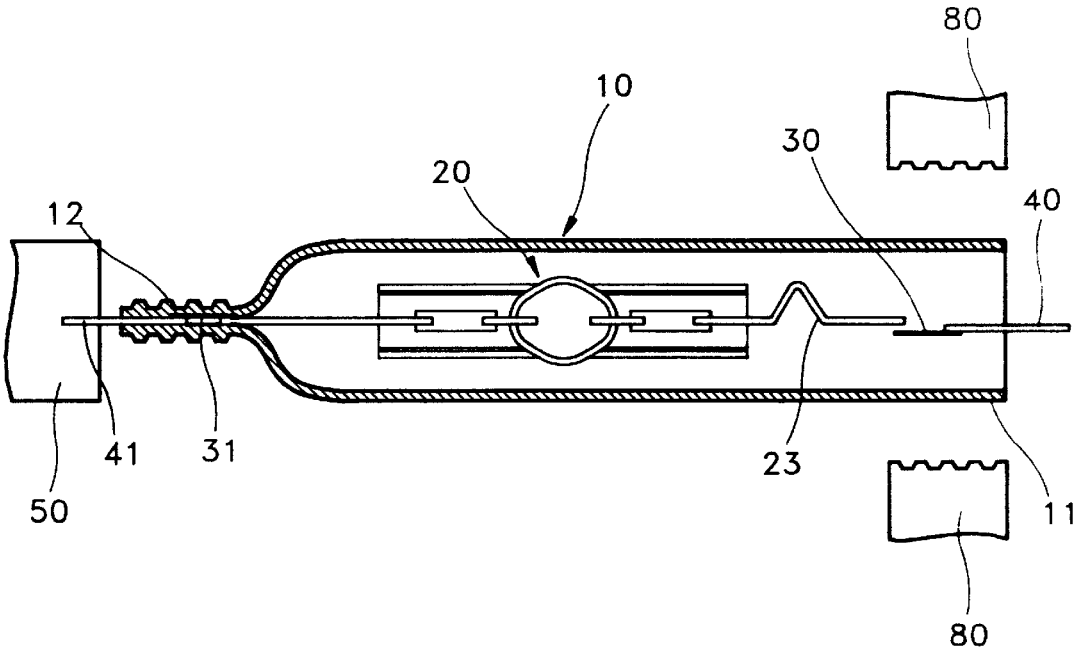

After that, the fixing member 70 which supports the first internal lead wire 23 is separated from the first end 11 of the case, and the first external lead wire 40 with the first metal lamina 30 affixed thereto is inserted into the first end 11 as shown in FIG. 6. The first external lead wire 40 is so fixed that the first metal lamina 30 can be positioned on an outer surface of the first internal lead wire 23 at the end thereof. Here, when the first end 11 of the case is sealed by the same method as that for sealing the second end 12 of the case, the first metal lamina 30 and the first internal lead wire 23 contact each other. Thus, the first internal lead wire 23 and the first external lead wire 40 being electrically connected to each other through the first metal lamina 30 are fixed to the first end 11 of the case 10.

When the external lead wires 40 and 41 are connected to the power supply, as described in FIG. 1, a potential difference is formed between the electrodes 21. Accordingly, an arc discharge occurs in the arc tube 20 to generate light.

According to a method for manufacturing a metal halide lamp of the present invention, the metal laminas fixed to the external and internal lead wires, adhere closely to each other when the case is sealed, and are simultaneously electrically connected to each other.

Accordingly, since the step of welding the metal laminas to the internal lead wires is omitted, the process is simplified, to thereby enhance productivity. Further, since the length of the lamp is not increased during the process, components used for manufacturing the metal halide lamp can easily be handled and preserved.

What is claimed is:

1. A method for manufacturing a metal halide lamp comprising the steps of:

positioning and fixing an arc tube having an electrode and an internal lead wire connected to said electrode inside a cylindrical case;

positioning and fixing an external lead wire with a metal lamina affixed to one end thereof in said case so that said metal lamina contacts an outer surface of said internal lead wire at the end thereof; and fixing said internal lead wire and said external lead wire by sealing an end of said case, thereby connecting said metal lamina and internal lead wire to each other.

* * * * *